US007296503B1

(12) United States Patent
McGrath

(10) Patent No.: US 7,296,503 B1
(45) Date of Patent: Nov. 20, 2007

(54) METHOD AND APPARATUS FOR NEUTRALIZING IMPROVISED EXPLOSIVE DEVICES AND LANDMINES AND MOBILE UNIT FOR PERFORMING THE METHOD

(76) Inventor: Alan Thomas McGrath, 4400 W. Lake Ave., Glenview, IL (US) 60026

( * ) Notice: Subject to any disclaimer, the term of this patent is extended or adjusted under 35 U.S.C. 154(b) by 0 days.

(21) Appl. No.: 11/337,318

(22) Filed: Jan. 23, 2006

(51) Int. Cl.
*B63G 7/02* (2006.01)

(52) U.S. Cl. ..... 89/1.13; 102/402

(58) Field of Classification Search ..... 89/1.13; 102/402

See application file for complete search history.

(56) References Cited

U.S. PATENT DOCUMENTS 2,349,728 A * 5/1944 Hopkins ..... 114/1
3,826,215 A * 7/1974 Dyjak ..... 114/221 R
3,946,696 A * 3/1976 Lubnow ..... 114/221 R
4,773,298 A 9/1988 Tischer
4,938,136 A * 7/1990 Gould ..... 102/406
5,001,485 A * 3/1991 Jones ..... 342/13
6,634,273 B2 10/2003 Cangelosi
6,854,375 B2 2/2005 Cangelosi

* cited by examiner

*Primary Examiner*—Stephen M Johnson

(57) ABSTRACT

Method and apparatus for the neutralization of improvised explosive devices by using electrical energy to render them inoperable or to explode them yards in front of a military vehicle equipped with the device. It is an object of the invention to counteract acts of terrorism by providing a safe means of transport through hostile territory by ensuring that explosive devices do not detonate directly underneath or alongside a vehicle equipped with the invention. The invention can also be carried aloft by a helicopter and used to destroy all the mines in a minefield quickly and efficiently.

7 Claims, 8 Drawing Sheets the invention installed on a HMMWV

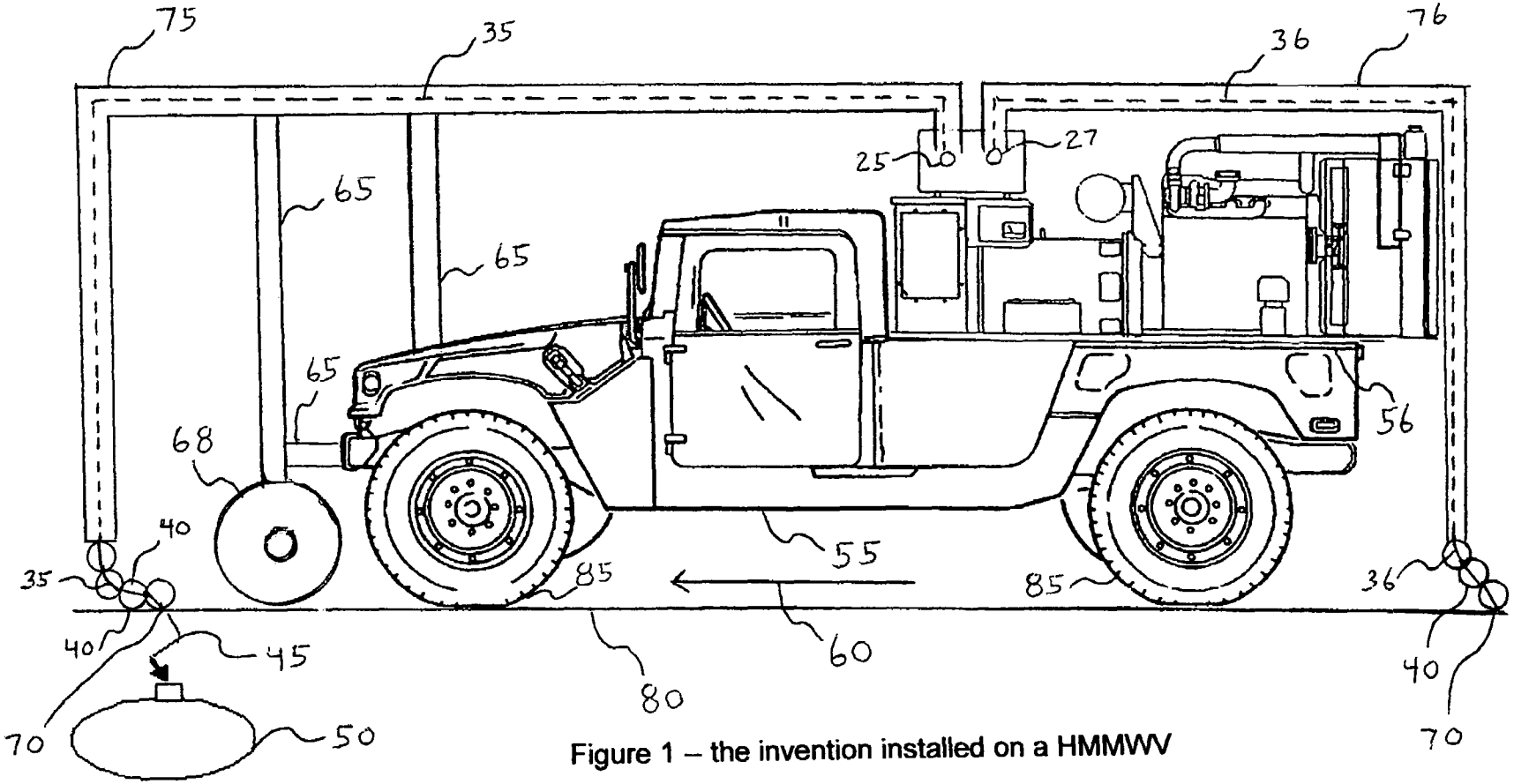
Figure 1 – the invention installed on a HMMWV

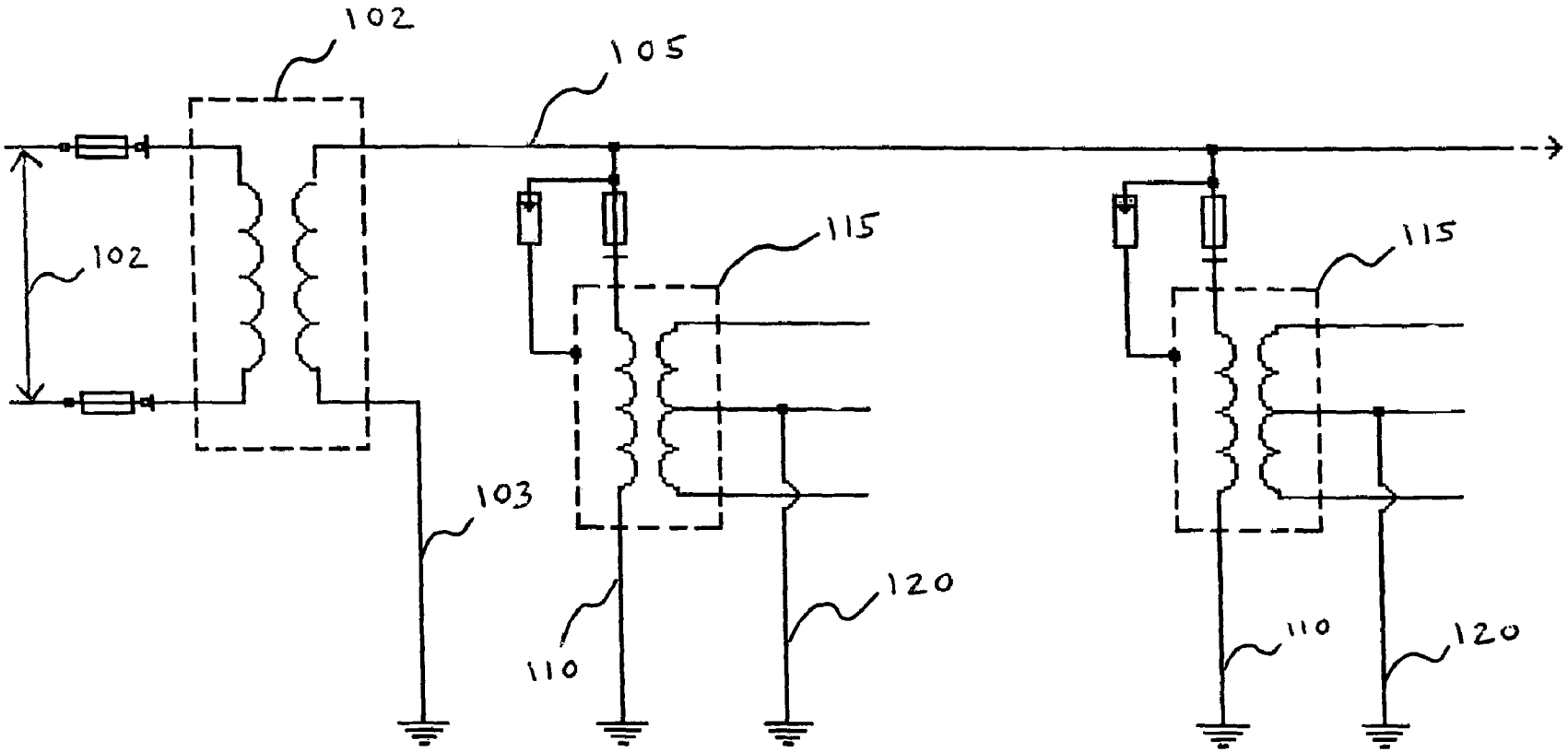
Figure 2 – the SWER Circuit used in the power transmission industry

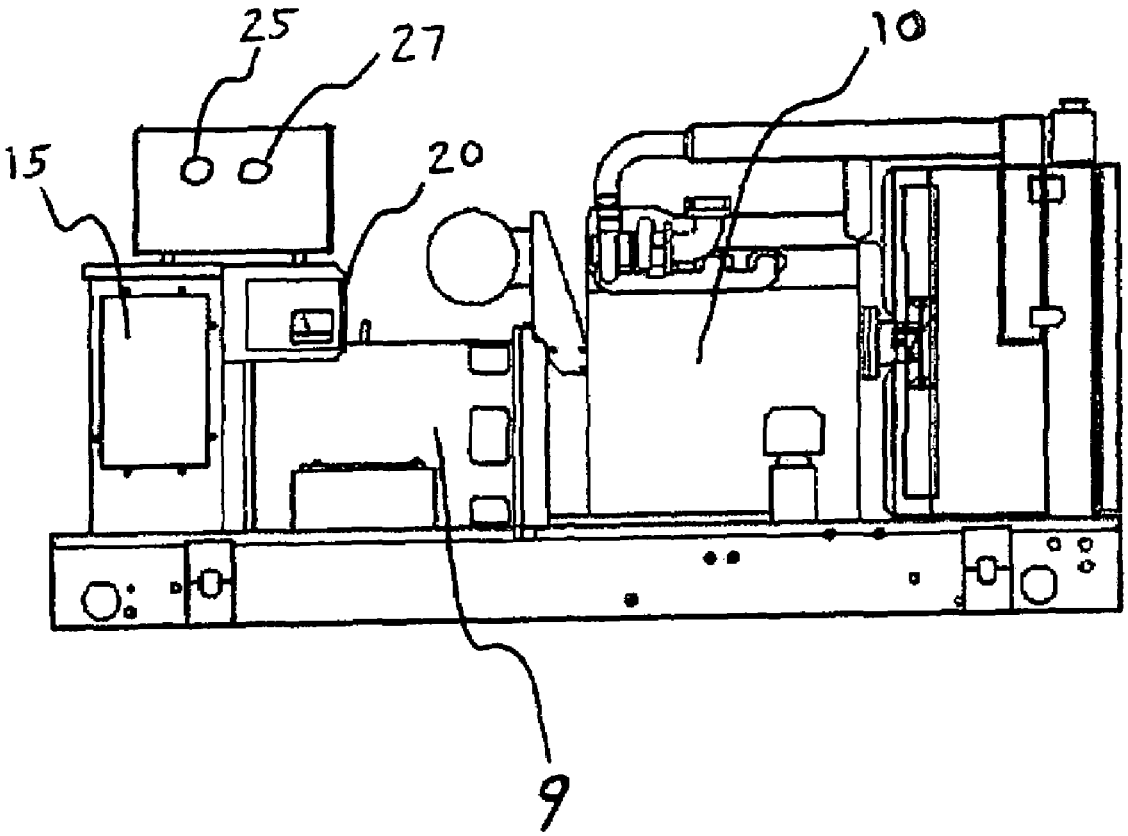
Figure 3 -- a 60 kW diesel electrical engine-generator

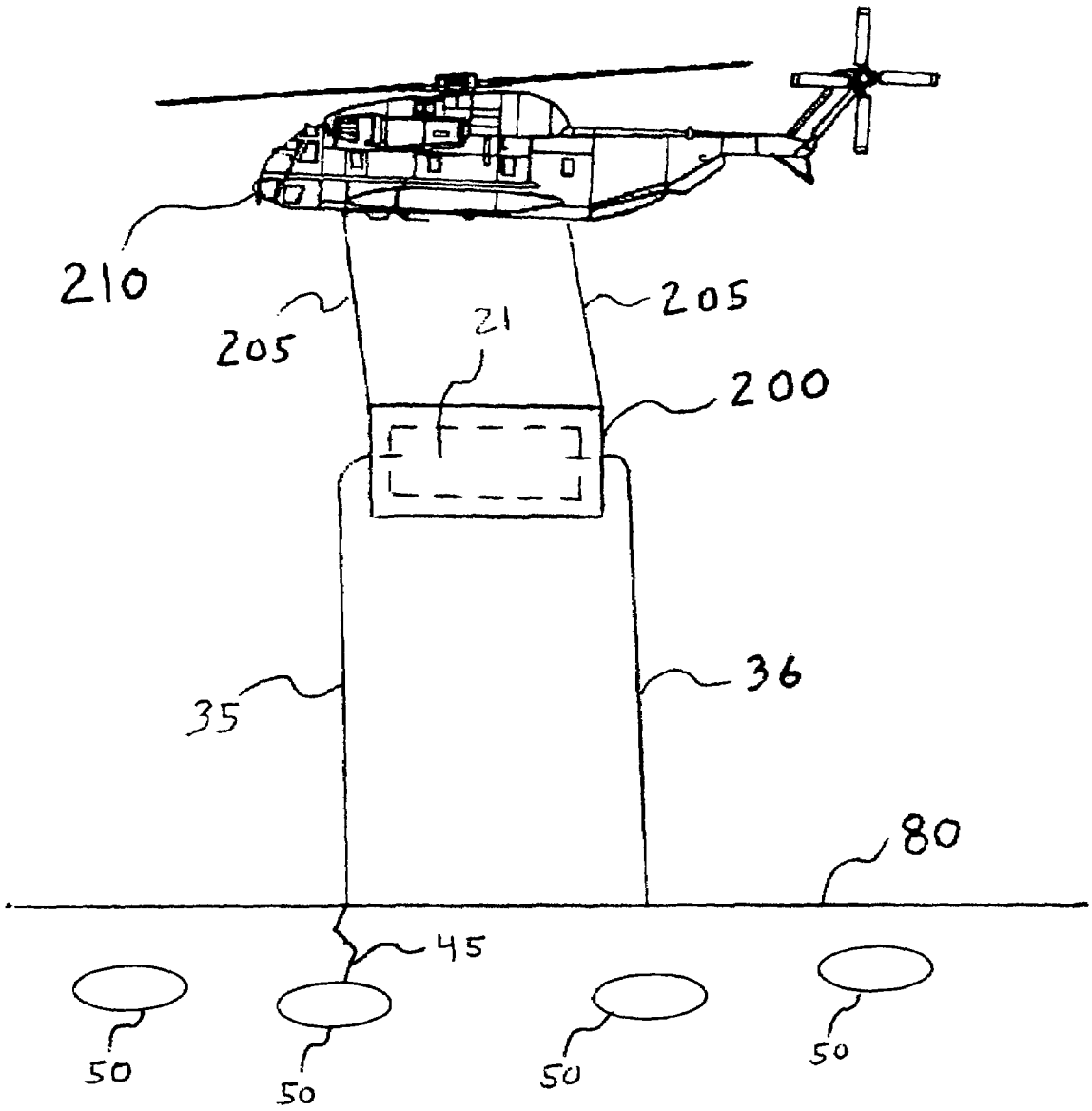
Figure 4 – the invention carried aloft by a helicopter

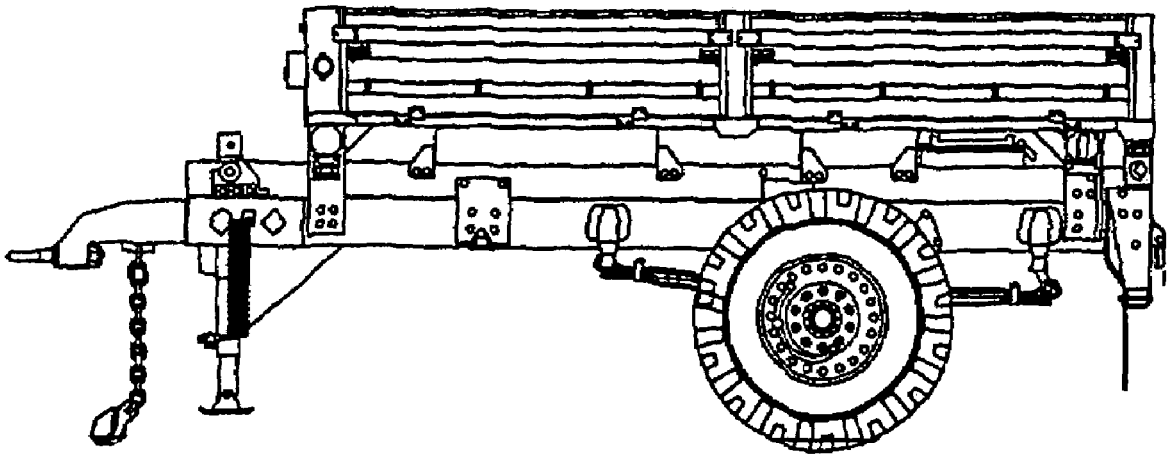
Figure 5 -- a military trailer

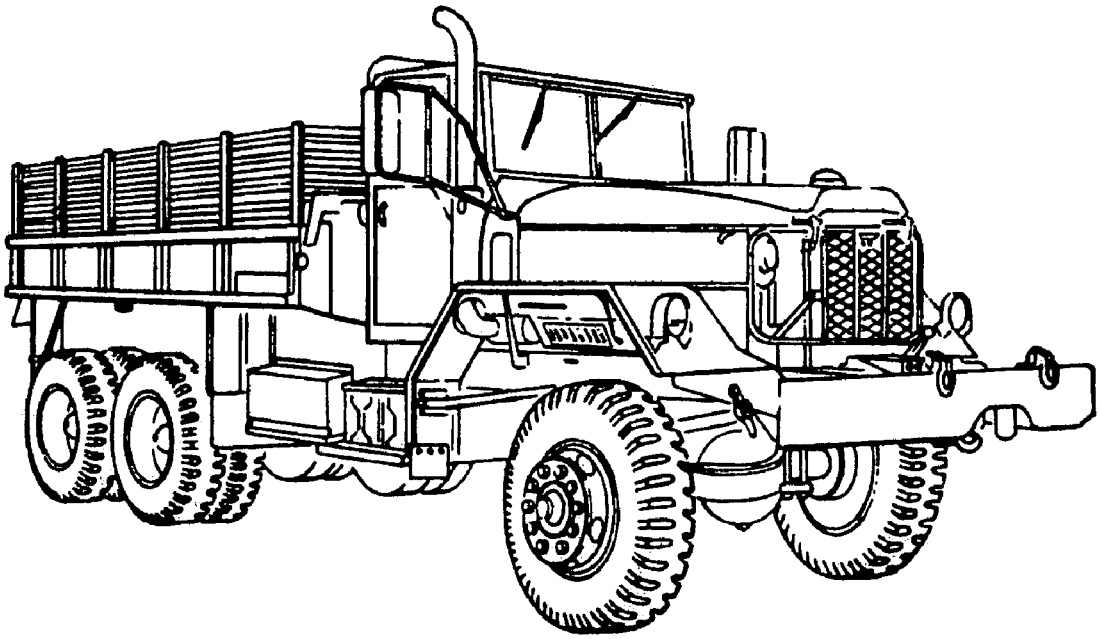
Figure 6 -- a military truck

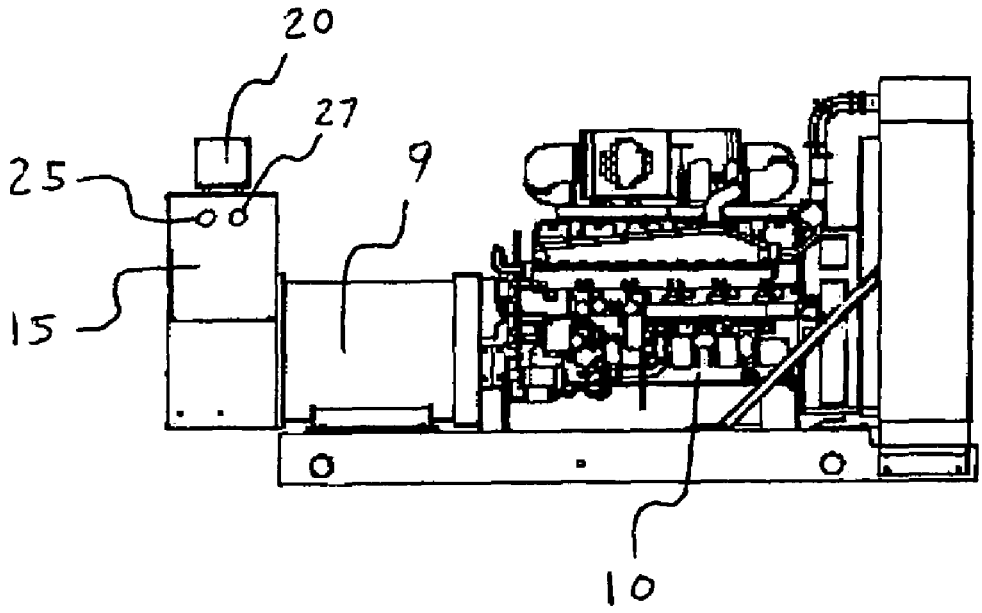
Figure 7 – a 725 kW diesel electrical engine-generator

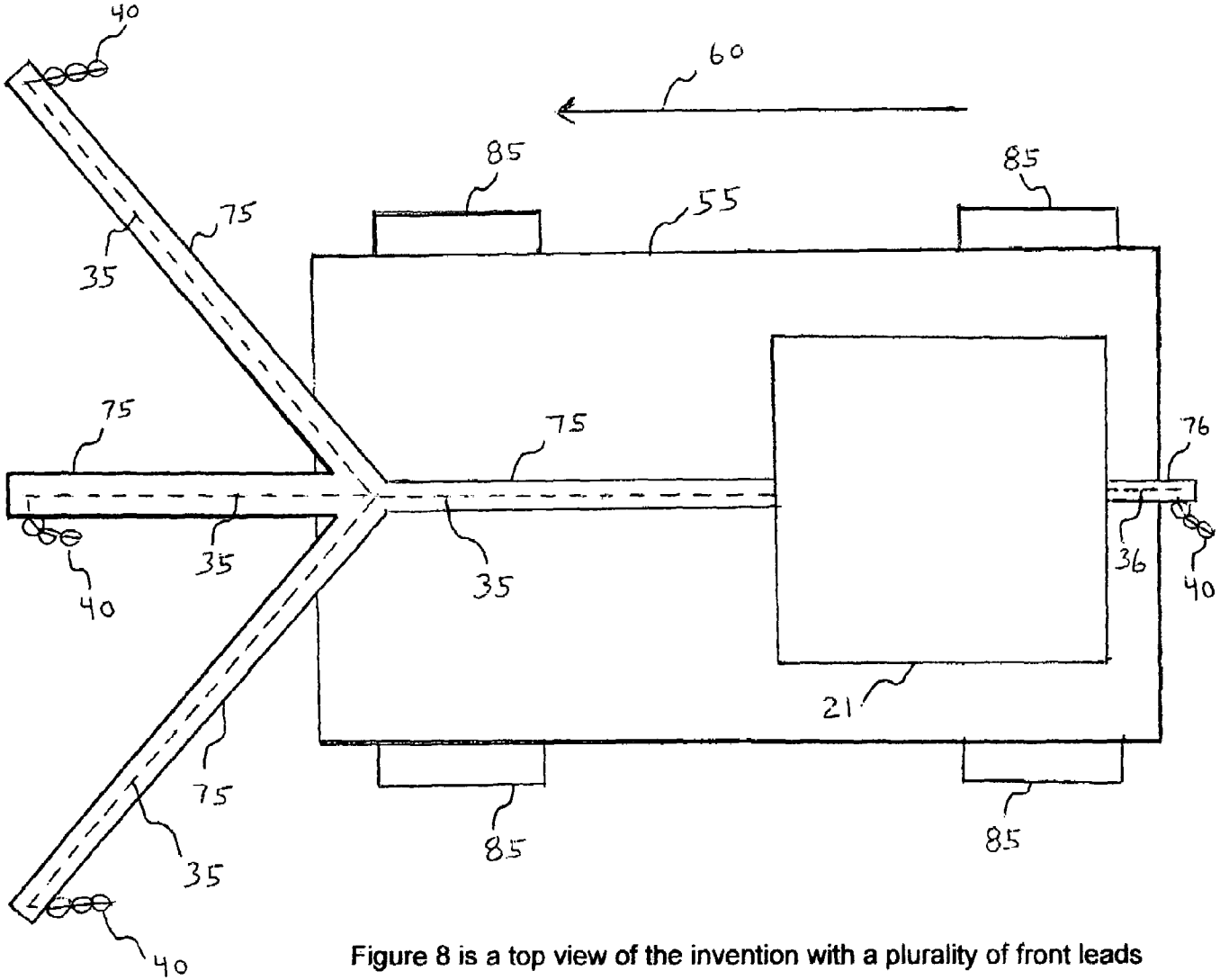
Figure 8 is a top view of the invention with a plurality of front leads

METHOD AND APPARATUS FOR NEUTRALIZING IMPROVISED EXPLOSIVE DEVICES AND LANDMINES AND MOBILE UNIT FOR PERFORMING THE METHOD

BACKGROUND OF THE INVENTION

1. Field of Invention

The present invention relates to an apparatus and method for neutralizing explosive devices and to a mobile unit for performing the method.

2. Prior Art

Mines, bombs and improvised explosive devices (IEDs) are being placed on roadways, within the roadways, and in potholes in the roadways in Iraq and Afghanistan and when an USA military vehicle crosses over them, they are being detonated. They have been responsible for hundreds of American casualties and there doesn't appear to be any reliable way of stopping them.

Almost anything that blows up can be turned into an IED, from grenades to plastic explosives to leftover mines. A trigger device can be put together out of the most everyday of electronics—a cell phone, a garage door opener, a child's remote-control toy. The hiding places for the handmade bombs are everywhere: in the ground, aboard a truck, even inside an animal carcass.

Most U.S. casualties continue to be from IEDs or automobile-borne bombs, some of them used in suicide missions.

Also, according to some sources, fifty-four countries have produced more than 340 models of antipersonnel landmines. They cost as little as $3 to produce and are relatively easy to deploy. They can be laid anywhere, including roads, paths, fields, buildings, waterways, bridges, forests, and deserts. By contrast, it costs between $300 and $1,000 to locate and destroy a single mine, typically a very complex and time-consuming task.

Landmines can remain active more than 50 years after they are buried in the ground. For this reason, there is a growing worldwide effort to rid the world of landmines.

Some of the current methods to render explosive devices inoperative or to detonate them are:

1) Mechanical clearing means.
2) Using mine detectors to locate them and carefully removing them.
3) Detonating them with an explosive charge.
4) Detonating them with directed-energy.
5) Jamming the signal that detonates them and rendering the electronics of the detonation device inoperable.
6) Salt water open loop method.

1) Mechanical Clearing Means

When there is not a lot of time for an army to clear a minefield, it will often employ the use of certain machines to roll through and clear a safe path. Military forces employ several kinds of mine-clearing machines to clear out or detonate mines. Some machines are specifically designed for the task of mine clearance, while tanks can also be fitted with certain mine-clearing devices.

One of the more effective methods uses a flail—a set of long chains attached to a rotating drum held out on arms across the front of the tank—to beat the ground. The HYDREMA™ 910 MCV is a mine clearing vehicle, designed for clearing of placed or buried personnel or antitank mines with up to 10 kg explosive weight. The vehicle is capable of clearing a 3.5 meter wide track on firm ground such as roads and runways or on other types of ground. The clearing is done when the rotating flail detonates the mines by milling and hitting the ground. During the mine clearing process, the vehicle is driven by a hydrostatic system in the direction opposite to the normal driving direction. The clearing can be done using the joysticks or through the advanced computerized fully automatic pilot steering system.

The HYDREMA™ has a metal protective shield and heavy chains that flail at high speeds to unearth, destroy or detonate mines on contact. The flail incorporates 72 chains and hammers (though more chains can be attached if desired) to detonate and destroy mines. It can be rotated in either direction.

A deflector plate made of armored steel is mounted behind the flail. It provides an extremely high protection against blast and fragments, and preventing objects from being thrown on the vehicle. Produced in Denmark, the vehicle was first put into service with the US military at Bagram Air Base, Afghanistan, in order to clear dangerous areas.

Mechanical clearing means, such as rollers and striking chains can only function against pressure sensors and can also destroy mines with sensor combinations, but the risk rate is high. However, these clearing means are not only very slow and clumsy, but become worn after a certain number of mine detonations. The most effective clearing method consists of removing the mined ground with the entire width of vehicle, but high technical expenditure and effort are required for this. In this clearing method soil and mines are hurled to the front and sides and consequently absolute mine-free corridors are formed. However, the clearing speed of this method is not very high.

During World War II, to counter the use of armored vehicles to clear mines, the Germans improvised anti-tank mines by burying an artillery shell deeper in the ground attached to a sensor some distance behind the shell, so that when the tank flail or dozer blade went over the sensor the shell exploded under the tank. Today, minefields are sometimes set with a mix of anti-personnel and anti-tank mines.

Modern mines are much more difficult to clear than mines having pressure detonators. Seismic sensors prevent mines being cleared by hand.

Tanks, like the U.S. Army M-1A1 ABRAMS™ main battle tank, are often equipped with a mine plow designed to push mines out of the tank's path. The plow consists of several blades that extract the mines, a moldboard to push the mines to the side and a leveling skid to control the depth of the blade. The PANTHER™ is a 60-ton remote-controlled vehicle that is based on a modified M-60 tank hull. Using a joy stick, an operator navigates the PANTHER™ through a minefield. The vehicle uses metal rollers to set off blast or magnetic mines.

Force Protection, Inc. BUFFALO™ AND COUGAR™ mine-protected vehicles have been used by the U.S. military in mine clearance missions for more than two years. They are known as fully-armored safe deposit boxes on wheels.

The BUFFALO™ could withstand bomb blasts that would shred a lesser vehicle. Mine detection teams can examine and remove potential explosive threats by using a 30-foot robotic arm without leaving the safety of the vehicle's steel hull, or by simply running over them.

This vehicle is built to absorb explosive forces so that its passengers don't have to. The extraordinary strength of the BUFFALO™ that allows it to run through mine fields undamaged is due to the blast protection technology incorporated into the vehicle. This includes a v-shaped design that deflects energy away from the hull, solid steel wheels, and five-inch-thick ballistic-protected glass.

A disadvantage of this method is that it requires a heavy military vehicle to perform the method.

2) Using Mine Detectors to Locate them and Carefully Removing them.

Landmine detection is a slow, methodical process due to the danger involved in locating landmines. While location technology is improving, the following conventional techniques are still relied on heavily:

Probing the ground—For many years, the most sophisticated technology used for locating landmines was probing the ground with a stick or bayonet. Soldiers are trained to poke the ground lightly with a bayonet, knowing that just one mistake may cost them their lives. Carefully searching suspected or known minefields areas for mines. Often this is done by crawling slowly into the field, inserting a probe (anything from a knife to a stick) into the soil to find hard objects. When walking in mined areas, mine-clearing personnel will wear large, pillow-like pads strapped under their feet, to spread their weight and dull the impact of their footsteps, as very slight disturbances of the ground can tip off old, unstable, or intentionally sensitive mine triggers.

Trained dogs—Dogs can be trained to sniff out vapors coming from the explosive ingredients inside the landmine. Using animals like dogs that can sniff out explosive chemicals like TNT in landmines. Experiments with the Gambian giant pouched rat have indicated that it has the required sensitivity to smell, can be trained reliably with food-reward incentives, and is typically too small to set off the mines.

Metal detectors—Metal detectors are limited in their ability to find mines, because many mines are made of plastic with only a tiny bit of metal. Using metal detectors to sweep a suspected minefield. However, the detectors may not easily differentiate various types of metal objects, which slows the search.

Scientists are developing a new ground-penetrating radar (GPR) device that may be more effective in locating and disarming landmines. This new device would be helpful in locating mines that have little or no metal content. All landmines, including plastic ones, are filled with explosive agents that have electrical properties that make them detectable to the right technology, such as GPR.

A GPR device focuses radar energy just below the ground and just a few feet in front of the user, according to researchers. The device ignores signals that bounce back from the surface and uses specially designed software to make buried objects shine brighter in the radar image. The GPR has been successful in detecting two common landmine casings filled with a waxy substance that is similar to TNT.

Once a landmine is detected, the GPR device shoots two chemical agents into the ground to deactivate it. One agent solidifies the triggering mechanism along with surrounding soil, allowing soldiers to cross the ground. The second chemical agent then solidifies the mine and soil permanently. The mine can then be shoveled out and destroyed.

Sowing genetically engineered flower seeds over suspected minefields from the air. The flowers bloom in distinctive colors when there are explosives nearby in the soil.

A disadvantage of this method is that it is slow and therefore can't be used to protect military vehicles traveling at 20 mph through the streets of Baghdad.

3) Detonating them with an Explosive Charge.

The essence of minefield breaching operations is speed. The fear that haunted Coalition planners in the Guld War was that the Iraqi minefields and obstacles would delay Coalition forces long enough for Iraq to deploy chemical weapons.

One of the fastest ways to breach a minefield is with explosives. The British system, the ROYAL ORDANCE GIANT VIPER™, uses eight rockets to carry a 67 mm diameter, 230-meter hose filled with aluminised PE6/A1 plastic explosive across a minefield. When it has landed, it is detonated in a spectacular explosion, clearing a gap 183 meters long and 7 meters wide. It will destroy most mines unless they have double-impulse fuses or are balst proofed.

Two vehicles towing GIANT VIPERS™ working in relays can clear a gap 400 meters deep. As an added precaution an armored vehicle fitted with a mine plough then clears through the gap following the explosion.

Similar line breaching systems are in use with the U.S. Army and marines, who use the M58A5 Mine Clearing Line Charge (MICLIC), and the Chinese Army which has a 425 mm Type 762 tank chasis mounted twin rocket system. One rocket in the Chinese system will clear a lane 130 meters long and 12 to 22 meters wide. The American MICLIC is trailer mounted like the GIANT VIPER™, and will clear a path 13.7 meters wide and 100.6 meters long.

On a smaller scale, man packable systems like the British Schermuly Rapid Anti-personnel Minefield Breaching System Mark 2 (RAMBS-2) can be fired from a rifle with standard ammunition. It has an explosive line 60 meters long which will clear AP mines to a width of 0.6 meters. Isreal Military Industries (IMI) have a portable system (POMINS 11) now adopted by the U.S. Army which will clear a path through barbed wire as well as clearing AP mines.

Among the most reliable, but also dangerous and time-consuming clearing methods is the use of individual relays charges, which are manually placed directly on or at the mine. However, this clearing procedure is completely unsuitable for the rapid overcoming of mine barriers.

Against modern mines, pyrotechnic clearing means are also not very effective, because they have a high resistance to blasting. Such sudden and powerful position changes of the type produced by detonating explosive, are absorbed by a shock blocking device fitted into land mines and consequently detonation is prevented.

A World War 1 telescopic wire clearing charge, known by the British as the Bangalore Torpedo, is still inuse in the U.S., Singapore, Pakistan, Isreal and Chile for both AP mine clearance and wire obstacle breaching.

A disadvantage of this method is it requires the knowledge of the location of the explosive devices and it requires the use of explosives which may not be readily available.

4) Detonating them with Directed-Energy.

Directed-energy is an umbrella term covering technologies that relate to the production of a beam of concentrated electromagnetic energy or atomic or subatomic particles.

The U.S. is introducing a new technology into the fight in Iraq that counteracts the effect of improvised explosive devices and bombs by making them ignite prematurely. The current goal is to find a way to not jam, but to pre-detonate IEDs or vehicle-borne bombs using microwave energy.

The goal is to project a power source of microwave energy such as a big spike of microwave energy from a truck- or aircraft-borne emitter into an enemy bomb that can fuse the circuitry of a blasting cap or pre-detonate it before the convoy gets there.

U.S. Pat. No. 4,773,298, which issued on Sep. 27, 1988, covered a method for locating, neutralizing and or detonating mines by the use of a laser beam:

> The method makes it possible to neutralize surface-laid or camouflaged and in particular intelligent land mines, in that a focused beam of a powerful laser unit is automatically or manually systematically guided over the surface to be cleared of land mines in a grid pattern, the movement sequence of the laser beam being program controlled, so that the laser beam in computer-assisted manner locates the laid mines both systematically in the SCAN process and also in planned manner and neutralizes or detonates them by introducing energy.

A disadvantage of this method is that a successful product using this method isn't available.

5) Jamming the Signal that Detonates them and Rendering the Electronics of the Detonation Device Inoperable The strongest push to silence the bombs has come from the Army, which has ordered thousands of radio-frequency jammers from manufacturers. The devices intercept the signal sent from a remote location to the IED instructing it to detonate. The signal cannot make contact, therefore when it can't make contact it doesn't detonate.

Also, other devices neutralize the IEDs with radio frequency by producing a very high-frequency field, in the microwave range, at very short range to take out an IED's electronics.

New signal-jamming equipment developed by New Mexico State University's Physical Science Laboratory in collaboration with the U.S. Army Research Laboratory is proving to be effective in defeating IEDs and saving soldiers' lives.

Known as ICE, for IED Countermeasure Equipment, the system was recognized recently as one of the U.S. Army's "Top Ten Greatest Inventions of 2004."

A disadvantage of this method is that it doesn't work on pressure sensitive landmines.

6) Salt Water Open Loop Method.

U.S. Pat. No. 6,634,273 covered an open loop minesweeping system. It's abstract states:

> An open loop magnetic field minesweeping system, with a small and light weight body to be towed through seawater by a towing cable from a helicopter or other vehicle, a single sweep cable extending rearwardly a substantial distance from the body with a first electrode in cable, sleeve or sock form attached to the end of the sweep cable, and a second electrode positioned forwardly of the body to be towed and extending along and connected to the towing cable. A rectifier and transformer on the body convert AC power fed to the towed body from the towing vehicle, to DC power applied across the first and second electrodes.

A disadvantage of this method is that it only works with marine mines.

None of the above inventions and patents taken either singly or in combination is seen to describe the instant invention as claimed. None of the above inventions and patents have eliminated the use of IEDs by terrorists. There have been over 700 fatalities caused by IEDs since the fall of Baghdad. Therefore, a portable and reliable method of neutralizing IEDs is needed.

OBJECTS AND ADVANTAGES

It is an object of the present invention to detonate the explosive device or render it inoperable before the vehicles carrying the invention gets too close to the explosive device so that the explosive device causes harm to the occupants of the vehicle.

It is an object of the present invention to detonate the explosive device or render it inoperable by using the invention while it is suspended above the explosive device or minefield by a helicopter.

It is an object of the present invention to counteract acts of terrorism by providing a safe means of transport through hostile territory by ensuring that explosive devices do not detonate directly underneath or alongside a vehicle equipped with the invention.

SUMMARY

An apparatus for neutralizing explosive devices at a safe distance from the vehicle equipped with the device. The main components are a diesel engine-generator that is placed in the cargo area of a high-mobility multipurpose wheeled vehicle (HMMWV) or towed behind the HMMWV or lifted above a mine field by a helicopter. Connected to the electrical box of the generator is a version of a circuit known as a single wire earth return circuit. One lead of the circuit is grounded at a distance in front of the HMMWV so as to send electricity into the ground. The second lead of the circuit is grounded at the rear of the vehicle completing the circuit.

As the HMMWV approached a buried explosive device, the electricity flowing from the generator, into the front lead, which is in a conduit reaching yards in front of the HMMWV, is allowed to flow into the ground in yards in front of the HMMWV. The electricity will explode the explosive device before the HMMWV reaches it. Injuries to the crew will be lessened if the explosive device is exploded a distance in front of the HMMWV when compared to it being detonated by a terrorist directly underneath the HMMWV.

The invention can also be placed in a standard 20×8.5×8 foot cargo container and flown over a known minefield by a helicopter. The two leads of the single wire earth return hang from the cargo container and are allowed to drag over the surface of the minefield. This will cause electricity to flow into the ground and into the buried explosive devices. The electricity will detonate the mines or render the mine's electronics inoperable.

DRAWINGS

FIG. 1 is the invention installed on a HMMWV

FIG. 2 is the SWER Circuit used in the power transmission industry

FIG. 3 is a 48 kW diesel electrical engine-generator

FIG. 4 is the invention carried aloft by a helicopter

FIG. 5 is a military trailer

FIG. 6 is a military truck

FIG. 7 is a 725 kW diesel electrical engine-generator

FIG. 8 is a top view of the invention with a plurality of front leads

DETAILED DESCRIPTION

Preferred Embodiment

A component of the invention is a power source such as an engine-generator 21. Diesel electrical engine-generators come in many different lengths, widths, heights, weight, and power ratings.

Illustrated in FIG. 3 is the electrical engine-generator having dimensions of 110.8" Long×40" Wide×55.1" High. It's weight is 2000 lbs. It is Generac Inc. Model No. SD-060. This model features a premium Generac Inc. model 3.0 DT, 5 cylinder, 96 HP, diesel fueled, liquid cooled engine with electric start. This model runs at 1800 RPM and generates 60 kW (60 kVA), of Standby (emergency or maximum) power and 48 kW prime (continuous) power at a primary voltage of 120/240 VAC, single phase, 60 Hertz, with 1% voltage accuracy.

Other components of the engine-generator are an engine 10, a generator 9, an electrical box 15, a electrical controller 20, and a first terminals 25 and a second terminal 27.

Another component of the invention is an electrical circuit known as a phantom loop. The phantom loop is an electrical network that uses part of a natural environment to complete a circuit. It is a form of an open system.

Examples include:

A long-distance electromagnetic telegraph, which in some cases used a ground as the return path for the circuit.

A single wire earth return power distribution systems for supplying power at low cost to a remote area. Single wire earth return (SWER) is a method of supplying single phase power to remote areas with low installation costs. The system uses a single conductor which, at each termination point, is passed through an isolation transformer with a second side of a primary winding connected to an earth pin, where the circuit is completed through the ground. SWER is an example of a phantom loop.

Illustrated in FIG. 2 is a SWER for supplying power at low cost to remote areas. Its main components are a source of power supply 100, an isolating transformer 102, a grounded lead 103, a single wire electrical transmission line 105, a single phase transformer 115, a high voltage grounded lead 110, and a low voltage grounded lead 120. A version of this SWER circuit is used in the invention and can be designed by a person with skill in the art.

Illustrated in FIG. 1 is a preferred embodiment of the invention. A High Mobility Multipurpose Wheeled Vehicle (HMMWV) 55 carries an engine-generator 21 in a cargo bed 56.

The payload capacity of a HMMWV 55 varies by body style ranging from 1920 lbs on the 4 litter ambulance to 5300 lbs on limited availability Expanded Capacity variant. Therefore, the 2000 lb engine-generator illustrated in FIG. 1 could easily be carried by the HMMWV 55.

A front lead 35 is connected to the engine-generator at a first terminal 25. The lead 35 is routed through a front conduit 75 which is supported with a supports 65. The support 65 could incorporate a support wheel 68. The front lead 35 makes contact with a surface 80 at a contact area 70. To aide in contact with the surface, a chain 40 can be used. The chain 40 is connected to the front conduit 75 and the front lead 35 is thread through the links of the chain 40. A charge of electricity 45 flows from the front lead 35 into the surface 80 and into an explosive device 50.

A rear lead 36 is connected to the engine-generator 21 at a second terminal 27. The rear lead 36 is routed through a rear conduit 76. The rear lead 36 is thread through the links of the chain 40 and makes contact with the surface 80 at the contact area 70 completing the SWER circuit.

The earth resistance for an average 5 foot ground rod measured 66 Ohms. Therefore the earth resistance for the lead 35 and 36 resting on the surface 80 would be considerably greater than 66 Ohms. However, the 48 kW produced by the generator shown in FIG. 3 will cause the electricity 45 to flow into the ground even with an earth resistance greater than 66 Ohms.

Operation of the Preferred Embodiment

As the HMMWV 55 travels forward in a direction of travel 60, it approaches the explosive device 50 on or under the surface 80. Electricity flows from the engine-generator 21, into the front lead 35 and into the surface 80 at the contact area 70. Ideally, the front conduit 75 projects far out in front of the HMMWV 55 so that the contact area 70 is at least 10 yards in front of the HMMWV 55. As the HMMWV 55 approaches the explosive device 50, electricity 45 flows from the front lead 35 into the explosive device 50 and the electricity 45 explodes the explosive device 50 (or renders the electronics inoperable) in front of the HMMWV 55 resulting in less casualties to the HMMWV's crew when compared to the explosive device being detonated by a terrorist directly underneath the HMMWV 55.

An explosive device is defined as a bomb, above ground land mine, a buried land mine, an IED, a marine mine, or other ordinance.

If the electricity 45 should flow into a metal structure such as a sewer line or a metal bridge, the occupants of the HMMWV 55 are insulated from electrical shock by a rubber tires 85. Additional protection for the HMMWV's crew can be provided if they wear a special conductive suit which is grounded, creating a Faraday shield effect.

Additional Embodiments

The front lead 35 can be divided into a plurality of front leads 35. Illustrated in FIG. 8 is a top view of the HMMWV 55 equipped with several front leads 35 each in a front conduit 75. Each front lead 35 terminates at the contact area 70 into the surface 80. The increased number of contact areas 70 increases the probability that the electricity 45 will explode the explosive devices 50 that is on or under the surface 80.

Instead of placing the engine-generator 21 in the cargo bed 56 of the HMMWV 55, the engine-generator 21 can be towed by the HMMWV 55 or other militery vehicle. Illustrated in FIG. 5 is a military trailor capable of towing a 5000 lb engine-generator.

The invention can also be used with or towed by Force Protection Incorporated's BUFFALO™ mine protected truck or COUGAR™ mine protected truck which has a payload capacity of 4000 lbs. Force Protection Inc. manufactures both trucks.

Instead of carrying the invention in a HMMWV or the towing the engine-generator, a military 5 ton truck can be used. Illustrated in FIG. 6 is the military 5-ton truck.

The maximum payload for the 5 ton truck is 20,000 pounds. The maximum towed load is 30,000 pounds. Therefore it is capable of carrying a larger engine-generator than the HMMWV can. For example, it could carry an industrial engine-generator illustrated in FIG. 7. It is a Kohler Mfr. Model: 750REOZM is a Diesel Series generator with 725 kW (906.25 kVA), of maximum output. Open dimensions are 168.7" Long×67" Wide×84.1" High. Open weight is 13700 lbs.

This model features a premium Kohler model D800 33.9A60, 12 cylinder, 1126 HP, diesel fueled, liquid cooled engine with electric start. This model runs at 1800 RPM and generates 725 kW (906.25 kVA), of Standby (emergency or maximum) power and 680 kW prime (continuous) power at a primary voltage of 120/208 VAC, three phase, 60 Hertz, with 2% voltage accuracy.

It is recommended that the 5 ton truck be retrofitted with armor. The armor kits are currently being manufactured by the Oshkosh Truck Company, Oshkosh, Wis.

A helicopter 210 can also carry aloft the invention above a minefield where the invention can safely detonate the explosive devices below without endangering personal. Illustrated in FIG. 4 is an embodiment of the invention carried inside a standard 20 foot long by 8.5 foot high by 8 foot wide cargo container 200 by a straps connected to the CH-53E SUPER STALLION™ helicopter 210.

The CH-53E SUPER STALLION™, the Marine Corps' heavy lift helicopter, is one of the few helicopters in the world configured with 3 gas turbine engines and in-flight refueling. The CH-53E is a larger version of the CH-53 SEA STALLION™, and the largest helicopter in the U.S. military inventory. It is used to transport personnel and equipment, lift heavy loads and conduct minesweeping missions. The Air Force version, equipped with sophisticated electronic countermeasures systems, is used for long-range delivery and resupply of special operations forces and combat rescue missions. The helicopter is capable of lifting 16 tons at sea level, transporting the load 50 nautical miles (57.5 miles) and returning.

The weight of the empty, open top cargo container 200 is 5070 lbs.

The CH-53E SUPER STALLION™ helicopter 210 is capable of carrying the industrial engine-generator illustrated in FIG. 7 when placed inside the cargo container 200.

This embodiment operates by having the helicopter 210 carrying the cargo container 200 which has the engine-generator as illustrated in FIG. 7 inside of it. The front lead 35 and the rear lead 36 exit the cargo container 200 and contact the ground 80 completing the SWER circuit. Electricity 45 flows from the leads into the explosive device 50 exploding it.

CONCLUSION

The foregoing description of a preferred embodiment of the invention has been presented for purposes of illustration and description, and is not intended to be exhaustive or to limit the invention to the precise form disclosed. The description was selected to best explain the principles of the invention and practical application of these principles to enable others skilled in the art to best utilize the invention in various embodiments and various modifications as are suited to the particular use contemplated. It is intended that the scope of the invention not be limited by the specification, but be defined by the claims set forth below.

LIST OF REFERENCE NUMERALS

9 Generator
10 Engine
15 Electrical box
20 Electrical Controller
21 Engine-generator
25 First terminal
27 Second terminal
35 Front lead
36 Rear lead
40 Chain
45 Electricity
50 Explosive device
55 HMMWV
56 Cargo bed
60 Direction of travel
65 Support
68 Support wheel
70 Contact area
75 Front conduit
76 Rear conduit
80 Surface
85 Tire
100 Power supply
102 Isolating transformer
103 Grounded lead
105 Transmission line
110 High voltage grounded lead
115 Single phase transformer
120 Low voltage grounded lead
200 Cargo container
205 Straps
210 Helicopter

What is claimed is:

1. A non-marine apparatus for exploding explosive devices or rendering them inoperable comprising:

a) a truck for carrying an electrical engine-generator;

b) an electrical circuit connected to said electrical engine-generator;

c) a first end of a front lead of said electrical circuit connected to a first terminal of said engine-generator;

d) a second end of said front lead completing the circuit into a surface at a front end of said truck;

e) electricity flowing from said engine-generator through said front lead into said explosive device;

f) a first end of a second lead of the said electrical circuit connected to a second terminal of said engine-generator; and g) a second end of said second lead being in contact with the surface.

2. Apparatus as in claim 1 wherein said front lead further comprises:

a) a front conduit having a first end and a second end;

b) said first end of said front conduit located at the engine-generator;

c) said second end of said front conduit located out in front of said truck;

d) said front lead entering said front conduit at said first end of said front conduit; and e) said front lead exiting said front conduit at said second end of said front conduit.

3. Apparatus as in claim 1 wherein the front lead is divided into a plurality of front leads, each front lead terminates to the surface.

4. Apparatus as in claim 1 wherein the engine-generator is a diesel engine generator.

5. Apparatus as in claim 1 wherein the circuit is a single wire earth return circuit.

6. Apparatus as in claim 1 wherein said truck is a HMMWV.

7. Method for exploding explosive devices comprising the steps of:

a) using an electrical engine-generator as a power source;

b) connecting a single wire earth return circuit to said engine-generator;

c) using a truck for to transporting said engine-generator and said single wire earth return circuit;

d) terminating a first lead of said circuit to a ground at a front end of said truck;

e) exploding an explosive device with an electrical current from said single wire earth return circuit; and f) terminating a second lead of said single wire earth return circuit to the ground.

* * * * *

US007296503C1

(12) INTER PARTES REEXAMINATION CERTIFICATE (1255th)

United States Patent

McGrath

(10) Number: US 7,296,503 C1

(45) Certificate Issued: Apr. 1, 2016

(54) METHOD AND APPARATUS FOR NEUTRALIZING EXPLOSIVE DEVICES AND LANDMINES AND MOBILE UNIT FOR PERFORMING THE METHOD

(76) Inventor: Alan Thomas McGrath, Glenview, IL (US)

Reexamination Request:
No. 95/001,970, Apr. 13, 2012

Reexamination Certificate for:

| | |
|---|---|
| Patent No.: | **7,296,503** |
| Issued: | **Nov. 20, 2007** |
| Appl. No.: | **11/337,318** |
| Filed: | **Jan. 23, 2006** |

(51) Int. Cl.

| | |
|---|---|
| ***B63G 7/02*** | (2006.01) |
| ***F41H 11/32*** | (2011.01) |

(52) U.S. Cl.

CPC ..... *F41H 11/32* (2013.01)

(58) Field of Classification Search

None

See application file for complete search history.

(56) References Cited

To view the complete listing of prior art documents cited during the proceeding for Reexamination Control Number 95/001,970, please refer to the USPTO's public Patent Application Information Retrieval (PAIR) system under the Display References tab.

*Primary Examiner* — Jeffrey R Jastrzab

(57) ABSTRACT

Method and apparatus for the neutralization of improvised explosive devices by using electrical energy to render them inoperable or to explode them yards in front of a military vehicle equipped with the device. It is an object of the invention to counteract acts of terrorism by providing a safe means of transport through hostile territory by ensuring that explosive devices do not detonate directly underneath or alongside a vehicle equipped with the invention. The invention can also be carried aloft by a helicopter and used to destroy all the mines in a minefield quickly and efficiently.

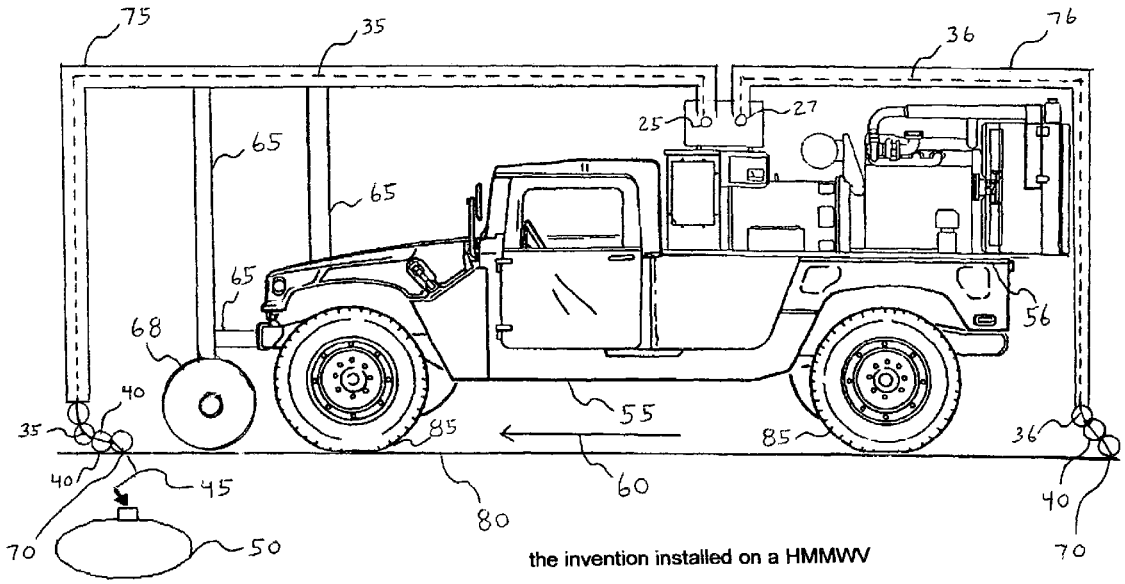

the invention installed on a HMMWV

INTER PARTES REEXAMINATION CERTIFICATE

THE PATENT IS HEREBY AMENDED AS INDICATED BELOW.

AS A RESULT OF REEXAMINATION, IT HAS BEEN DETERMINED THAT:

Claims 1-7 are cancelled.

* * * * *